US007227962B2

(12) United States Patent
Mieda et al.

(10) Patent No.: US 7,227,962 B2
(45) Date of Patent: Jun. 5, 2007

(54) ONE-TERMINAL EFFECTOR

(75) Inventors: Fumio Mieda, Tokyo (JP); Yasuhiko Mori, Tokyo (JP)

(73) Assignee: Korg Inc., Tokyo (JP)

( * ) Notice: Subject to any disclaimer, the term of this patent is extended or adjusted under 35 U.S.C. 154(b) by 830 days.

(21) Appl. No.: 10/196,079

(22) Filed: Jul. 16, 2002

(65) Prior Publication Data

US 2003/0016831 A1 Jan. 23, 2003

(30) Foreign Application Priority Data

Jul. 18, 2001 (JP) ..... 2001-218492

(51) Int. Cl.
*G10H 1/00* (2006.01)

(52) U.S. Cl. ..... 381/118; 381/61

(58) Field of Classification Search ..... 381/61, 381/118

See application file for complete search history.

(56) References Cited

U.S. PATENT DOCUMENTS 5,103,190 A * 4/1992 Noro ..... 330/298

* cited by examiner

*Primary Examiner*—Curtis Kuntz
*Assistant Examiner*—Alexander Jamal
(74) *Attorney, Agent, or Firm*—Fogg and Associates; David N. Fogg

(57) ABSTRACT

Provides a one-terminal effector having an input terminal and an output terminal structured as one terminal by providing a circuit that makes input and output of the effector common. The one-terminal effector can avoid complex cable wiring, and can prevent degradation of sound quality. The one-terminal effector includes one input/output terminal, and an effector circuit that executes a predetermined processing on an analog audio signal that is input from the input/output terminal, and outputs the processed analog audio signal from the input/output terminal. The one-terminal effector further includes an input/output signal conversion circuit that converts the input signal and the output signal into mutually different signal forms of voltage signals or current signals.

4 Claims, 12 Drawing Sheets

ONE-TERMINAL EFFECTOR

This application claims the benefit of priority to the earlier filed Japanese Application No. 2001-218492, filed on Jul. 18, 2001.

BACKGROUND OF THE INVENTION

1. Field of the Invention

The present invention relates to an effector, and relates, more particularly, to a circuit structure and a physical structure of an effector that is externally connected to a guitar amplifier or an acoustic mixer to provide a predetermined acoustic effect.

2. Description of the Related Art

FIG. 1 shows one example of a connection structure of a guitar using a conventional effector.

In FIG. 1, a connection cable from a guitar 1 is connected to an input terminal of an effector (Fx) 2, and an output terminal of the effector 2 is connected to a terminal A of a guitar amplifier 3 using another cable.

The effector 2 is a digital effector that has recently become common. An electrical signal from the guitar 1 (or a microphone or the like) is converted into a digital signal by an A/D converter that is provided at the input terminal side of the effector 2.

This signal is digitally processed by an internal DSP (digital signal processor) to have a predetermined acoustic effect such as a distortion, a compressor, a reverb, and a chorus, for example. Then, the signal is converted into an analog signal by a D/A converter that is provided at the output terminal side of the effector 2, and this analog signal is input to the guitar amplifier 3.

As explained above, the conventional effector 2 has an input terminal and an output terminal independently. Therefore, when the effector 2 is used to play the guitar 1, two cables are necessary, one for connection between the guitar 1 and the effector 2, and the other for connection between the effector 2 and the guitar amplifier 3. When a plurality of effectors are used to play the guitar, more cables become necessary to connect between these effectors.

Consequently, the above connection had a problem that the cable wiring becomes complex. The use of a plurality of cables also had a problem in the sound quality aspect such as increase in noise or degradation of a high-frequency sound characteristic. It should be taken into account that many guitarists prefer connecting a guitar directly to a guitar amplifier using a cable, and tend to dislike degradation of the sound quality due to the existence of complex cables and electronic appliances like effectors.

Although not shown in the drawing, when a mixer is used, it is necessary to connect effectors to individual tracks of the mixer. For this purpose, send/return terminals (two terminals) become necessary for each track at the mixer side to connect between the mixer and each effector. This structure constrains external sizes of the mixer itself, and increases the manufacturing cost of the mixer. As a result, the use of the conventional effectors has also affected other units that are connected to the effectors.

SUMMARY OF THE INVENTION

In the light of the above problems, it is an object of the present invention to provide an effector having an input terminal and an output terminal structured as one terminal by providing a circuit that makes input and output of the effector common. The use of the effector of the present invention makes it possible to connect a guitar directly to a guitar amplifier. This can avoid complex cable wiring, and can prevent degradation of sound quality attributable to this cable wiring. Further, it is possible to reduce the constraints applied to other units that are connected to the effector.

It is another object of the present invention to provide an extremely compact effector structure having a short cable length that is equipped with the circuit that makes input and output of the effector common. Depending on need, it is possible to additionally connect a conventional effector to the effector of the present invention.

According to one aspect of the present invention, there is provided a one-terminal effector comprising one input/output terminal, and an effector circuit that executes a predetermined processing on an analog audio signal that is input from the input/output terminal, and outputs the processed analog audio signal from the input/output terminal. According to another aspect of the invention, the one-terminal effector further comprises an input/output signal conversion circuit that converts the input signal and the output signal into mutually different signal forms of voltage signals or current signals.

According to still another aspect of the invention, the one-terminal effector further comprises a negative impedance circuit, wherein the negative impedance circuit is structured as a floating impedance circuit that offsets a load impedance connected to the input/output terminal, and connects between the input/output terminal and the effector circuit.

According to still another aspect of the invention, there is provided an effector apparatus comprising one input/output mechanism, and an effector unit that incorporates an effector circuit that executes a predetermined processing on an analog audio signal that is input from the input/output mechanism, and outputs the processed analog audio signal from the input/output mechanism. According to still another aspect of the invention, the effector apparatus further comprises an external connection mechanism, wherein at least one external effector unit connected to the external connection mechanism is connected in series with the effector inside the effector unit.

It is possible to apply the effector structure of the present invention to a general signal processing unit. According to still another aspect of the invention, there is provided a signal processing unit comprising one input/output terminal, a signal processing circuit that executes a predetermined processing on a signal input from the input/output terminal, and outputs the processed signal from the input/output terminal, and an input/output signal conversion circuit that converts the input signal and the output signal into mutually different signal forms of voltage signals or current signals.

BRIEF DESCRIPTION OF THE DRAWINGS

The present invention will be more clearly understood from the description as set forth below with reference to the accompanying drawings.

DESCRIPTION OF THE PREFERRED EMBODIMENTS

Figure 1:
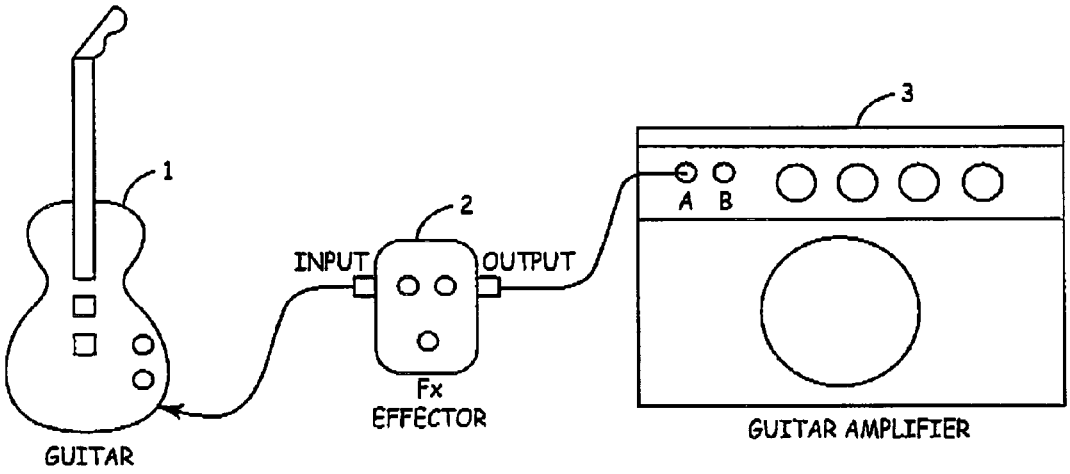
FIG. 1 PRIOR ART
FIG. 1 is a diagram showing one example of a connection structure of a guitar using a conventional effector.
Figure 2:
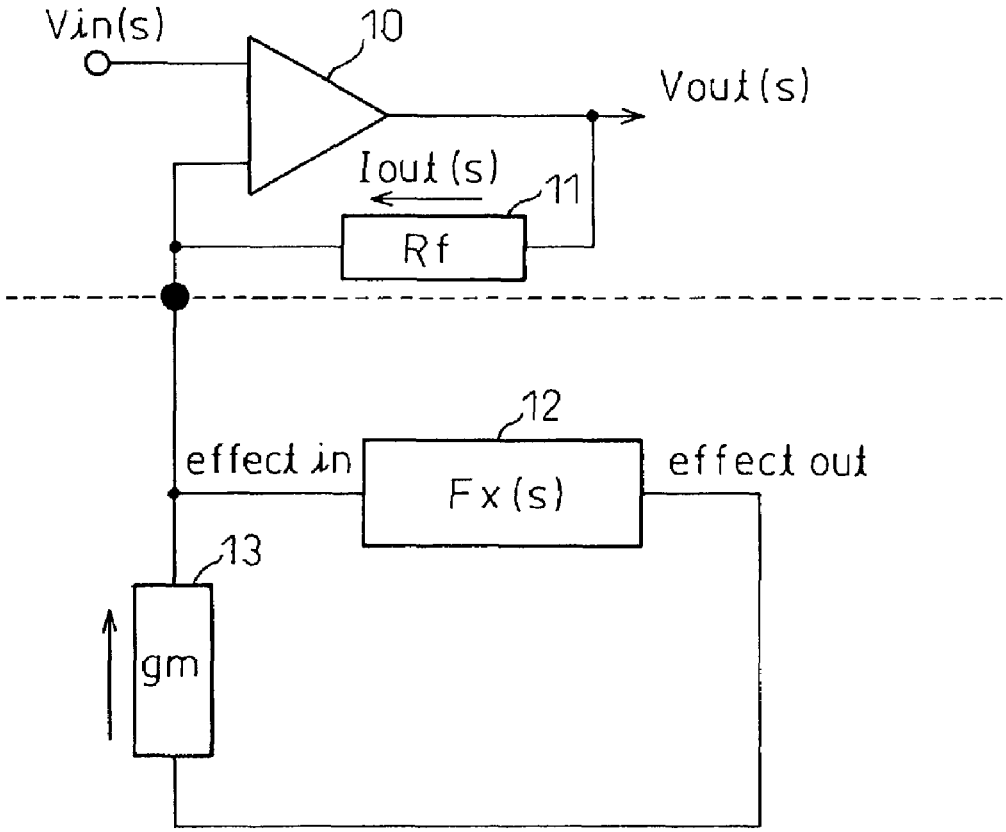
FIG. 2 is a diagram showing a first principle structure of a one-terminal effector according to the present invention.

FIG. 2 is a diagram showing a first principle structure of a one-terminal effector according to the present invention. In FIG. 2, a portion above a dotted line at the center of the drawing corresponds to the guitar amplifier 3 shown in FIG. 1, and a portion below the dotted line corresponds to a one-terminal effector according to the present invention. A white circle in the drawing corresponds to an input terminal A of the guitar amplifier 3, and a black circle in the drawing corresponds to an input terminal B of the guitar amplifier 3. Vout(s) represents an input signal to an amplifier circuit inside the guitar amplifier 3. The one-terminal effector side is constructed of an effector section (Fx(s)) 12 and a mutual conductance (gm) 13.

Figure 3A:
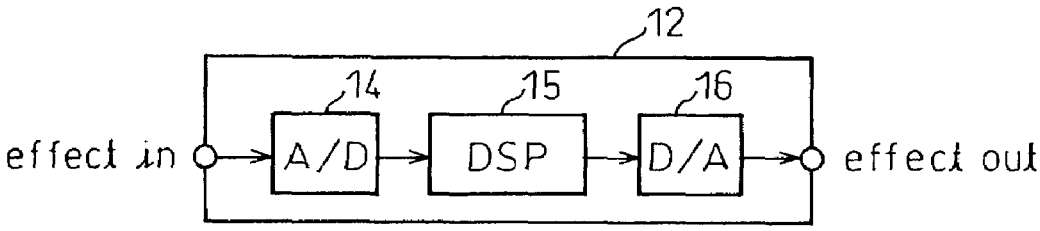
FIG. 3A is a diagram showing one example of a circuit structure of an effector section shown in FIG. 2.
Figure 3B:
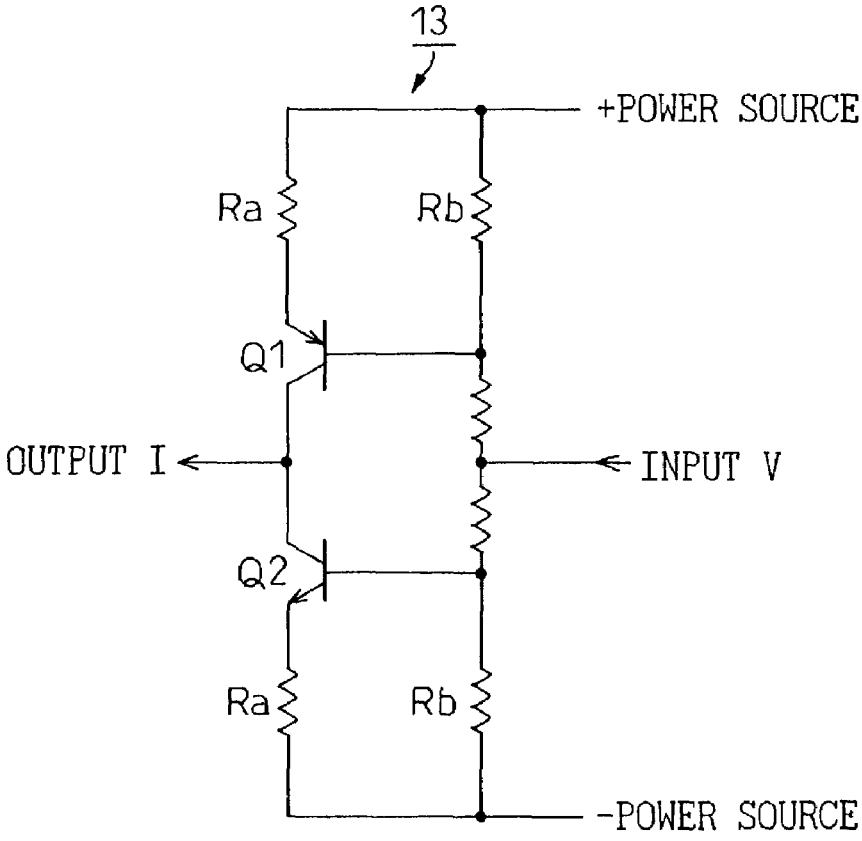
FIG. 3B is a diagram showing one example of a circuit structure of the mutual conductance shown in FIG. 2.

FIGS. 3A and 3B show one example of a circuit structure of the effector section 12 and the mutual conductance 13 shown in FIG. 2, respectively.

FIG. 3A shows an example of the effector section 12 structured by a digital signal processing circuit consisting of an A/D converter 14, a DSP 15, and a D/A converter 16. FIG. 3B shows an example of the mutual conductance 13 structured by a voltage-current conversion circuit consisting of a transistor circuit. In this circuit, an output current (I) that is a potential change of an input voltage (V) multiplied by Ra/Rb times is output. Therefore, gm=I/V.

Referring back to FIG. 2, in the present invention, a cable from the guitar 1 is directly connected to the input terminal A (the white circle) of the guitar amplifier 3. A signal Vin(s) from the guitar 1 is input to one input terminal (the white circle) of a differential amplifier section 11, and a portion between two input terminals of the differential amplifier section 11 is kept at the same potential based on an imaginary shortage. Therefore, the following expression (1) is established.

$$Iout(s)=(Vout(s)-Vin(s))/Rf=Vin(s)*Fx(s)*gm \quad (1)$$

The above expression is rearranged as follows.

$$Vout(s)/Vin(s)=Rf*Fx(s)*gm-1 \quad (2)$$

In the above, Rf*Fx(s)*gm>>1. Therefore, Vout(s)=A*Fx(s)*Vin(s), and A becomes a constant. As a result, the signal Vin(s) from the guitar 1 becomes the signal (Vout(s)) to which the effector effect (Fx(s)) has been applied.

The circuit operation of the above relationship will be explained next. Vin(s) is input to the effector section 12 based on the imaginary shortage. An output signal with a predetermined acoustic effect applied thereto is converted into a corresponding signal by the mutual conductance 13. A feedback current Iout(s) of the differential amplifier section 11 flows through a feedback resistor (Rf) 11 to offset this signal current. Therefore, as an output of a differential amplifier section 10, a signal (Vout(s)) that is a signal multiplying the value of a current from the mutual conductance 13 by the feedback resistance Rf is output.

Figure 4:
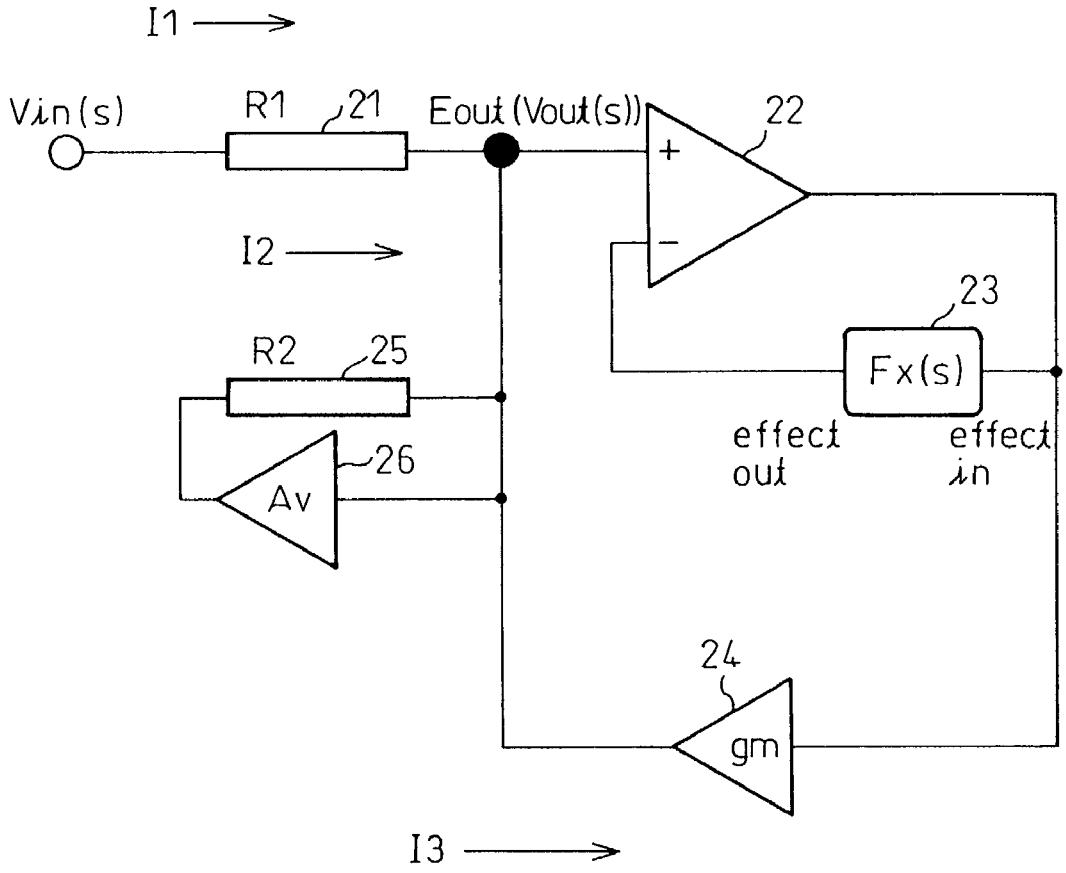
FIG. 4 is a diagram showing a second principle structure of a one-terminal effector according to the present invention.

FIG. 4 is a diagram showing a second principle structure of a one-terminal effector according to the present invention.

In FIG. 4, a white circle also corresponds to the input terminal A of the guitar amplifier 3, and a black circle also corresponds to the input terminal B of the guitar amplifier 3. An effector section (Fx(s)) 23 and a mutual conductance (gm) 24 are identical with those used in FIGS. 3A and 3B. A cable from a guitar 1 is also directly connected to the input terminal A (the white circle) of the guitar amplifier 3.

When an input signal Vin(s) has been applied, currents I1(s), I2(s), and I3(s) that are generated within the circuit are in the relationship of I1(s)+I2(s)=I3(s). Therefore, the following expression (3) is established.

$$(Vin(s)-Eout(s))/R1+Eout(s)*(Av-1)/R2=Eout(s)*gm/Fx(s) \quad (3)$$

R1, R2, and Fx(s) are multiplied to both sides of the expression (3) to obtain the following expression.

$$R2*Fx(s)*(Vin(s)-Eout(s))+R1*Fx(s)*Eout(s)*(Av-1)=R1*R2*Eout(s)*gm$$

When R1=R2 R, and Av=2, the following expression is obtained.

$$Eout(s)=Fx(s)*Vin(s)/(R*gm) \quad (4)$$

Therefore, also in the present example, the signal Vout(s) (=Eout(s)) that is output to the amplifier circuit inside the guitar amplifier 3 becomes Vout(s)=A*Fx(s)*Vin(s) from the expression (4), and A becomes constant. As a result, the signal (Vout(s)) that is the signal Vin(s) from the guitar 1 with the effector effect (Fx(s)) applied thereto is output. In the present structure, a constant term −1 in the above expression (2) of the first principle structure does not exist. Therefore, the condition Rf*Fx(s)*gm>>1 is not necessary.

Figure 5A:
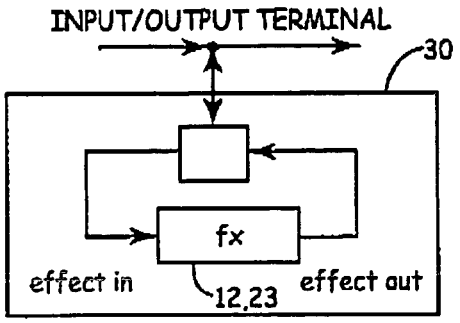
FIG. 5A is a diagram that graphically shows a connection structure of a one-terminal effector according to the present invention.
Figure 5B:
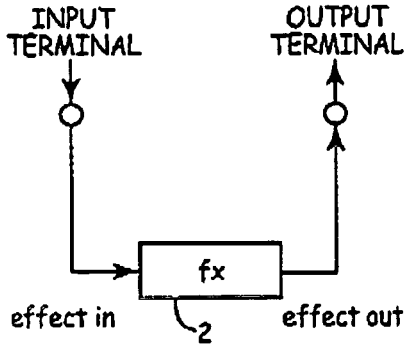
FIG. 5B PRIOR ART
FIG. 5B is a diagram that graphically shows a connection structure of a conventional effector.

FIGS. 5A and 5B graphically show a difference between a connection structure of a one-terminal effector 30 according to the present invention and a connection structure of a conventional effector 2.

As shown in FIG. 5A, the one-terminal effector 30 according to the present invention is connected to one input/output terminal (a black circle), and the input signal with a predetermined acoustic effect applied thereto is output to the same terminal (the black circle). On the other hand, the conventional effector 2 shown in FIG. 5B has an input terminal and an output terminal separated from each other. A predetermined acoustic effect is applied by the effector to a signal that has been input to the input terminal, and this signal is output from the other output terminal.

As explained above, according to the present invention, by only connecting a signal processing unit having a transmission function Fx(s) at one point, it is possible to obtain an effect similar to the effect obtained by inserting effectors in series with a signal route like in the conventional example. With regard to a function in which a Laplace transformation Fx(s) exists by regarding that a relationship between an input X and an output Y is a function of Y=fx(X) having a time variable, it is possible to realize this function in the structure of the present invention by using a common terminal for the input signal and the output signal of the signal processing unit of the transmission function Fx(s). For example, in a signal processing unit that simulates a real physical phenomenon or aims at an analog acoustic signal processing, it is possible to realize this function by processing the input signal of the signal processing unit as a voltage and processing the output signal as a current.

An example of an application of the one-terminal effector of the present invention to an actual guitar amplifier will be explained below.

Figure 6:
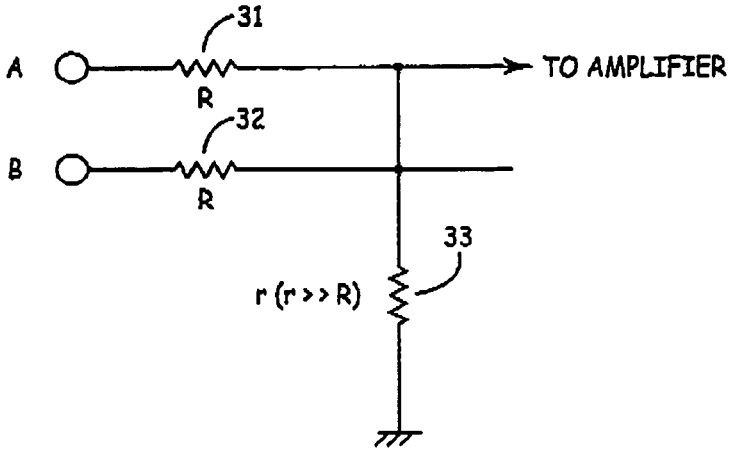
FIG. 6 is a diagram showing one example of an input circuit of input terminals A and B of a guitar amplifier.

FIG. 6 shows one example of an input circuit of the input terminals A and B of the guitar amplifier 3 (FIG. 1). Inputs applied to the input terminals A and B are supplied to an amplifier circuit (AMP) incorporated in a guitar amplifier 3 via input resistors 31 and 32 respectively that have the same resistance R.

Figure 7B:
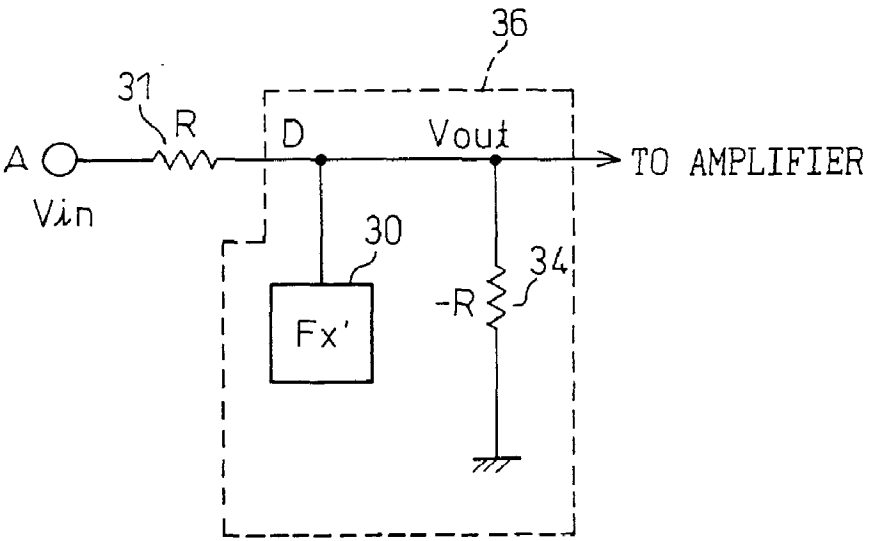
FIG. 7B is a diagram showing a principle structure (2) to connect a one-terminal effector of the present invention to a guitar amplifier.
Figure 7A:
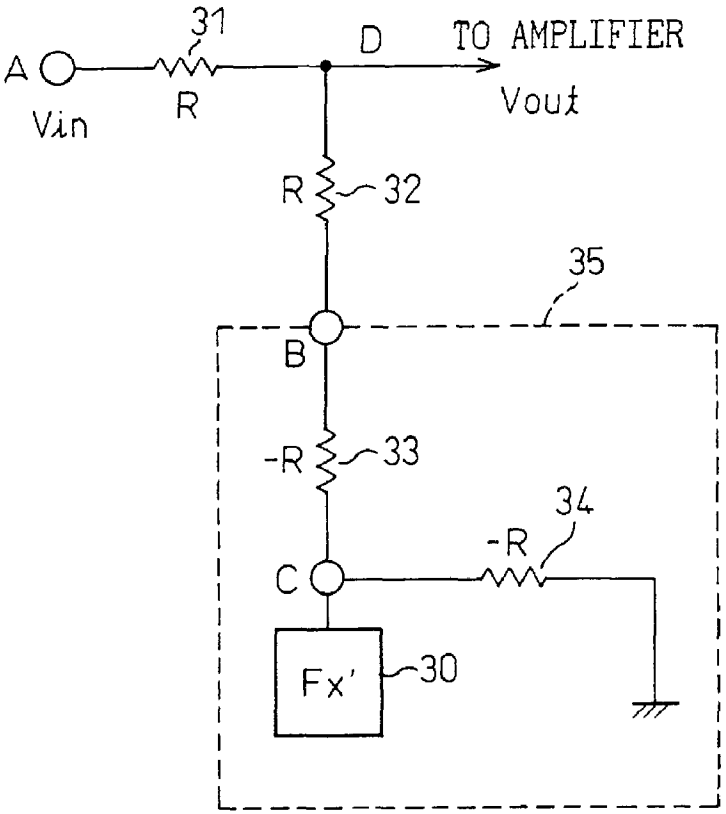
FIG. 7A is a diagram showing a principle structure (1) to connect a one-terminal effector of the present invention to a guitar amplifier.

FIGS. 7A and 7B show a principle structure to connect a one-terminal effector of the present invention to the guitar amplifier 3.

In FIG. 7A, a cable from the guitar 1 is directly connected to an input terminal A. A one-terminal effector apparatus 35 according to the present invention is connected to an input terminal B. A resistor 33 having a negative resistance −R in the one-terminal effector apparatus 35 is provided to offset a resistance R in an input circuit 32 at the input terminal B.

A resistor 34 having a separate negative resistance −R is constructed of an amplifier 26 and a resistor 25 in the second principle structure shown in FIG. 4. In the present structure, a constant term −1 in the above expression (2) of the first principle structure is erased, and the condition Rf*Fx(s)*gm>>1 is not necessary. In other words, the second principle structure shown in FIG. 4 is used as the one-terminal effector according to the present invention. When the resistor 34 having the negative resistance −R does not exist, Vout(s) becomes Fx(s)/(R+Fx(s)). As an unnecessary term is generated in the denominator, this relationship is not desirable. When the resistor 34 exists, Vout(s) becomes Fx(s)/R, and this satisfies the relationship of Vout(s)=k*Fx(s) (where K is a constant).

The circuit structure shown in FIG. 7A becomes equivalent to the circuit structure shown in FIG. 7B. As the resistance of the input resistor at the input terminal B is offset by the resistance of the negative resistance 33, the portion between these points becomes equivalent to a direct connection (a point D and a point C are connected directly). A point D in FIG. 7B corresponds to the point (the black circle) that corresponds to the input terminal B shown in FIG. 2 and FIG. 4 respectively. Fx' 30 shown in FIGS. 7A and 7B is equivalent to the one-terminal effector circuit 30 shown in FIG. 5A.

Figure 8:
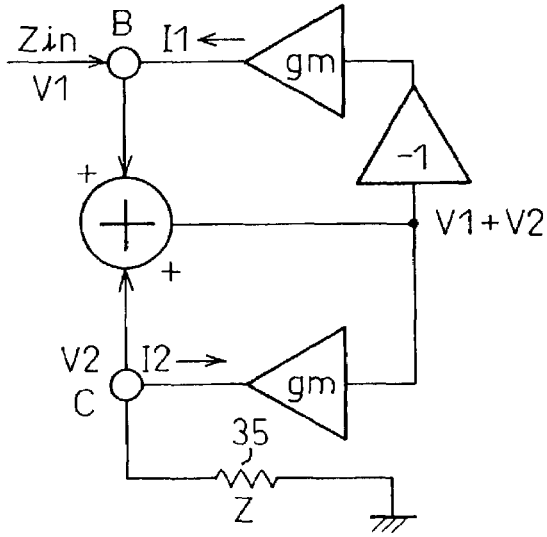
FIG. 8 is a diagram showing a structure principle of a negative impedance of a floating structure.

FIG. 8 shows a principle structure of the negative resistance 33 provided between points B and C shown in FIG. 7A. The negative resistance 33 is different from a conventional impedance (for example, the negative resistance 34) to which an external load can be connected at only one terminal, in the point that the negative resistance 33 is structured as a floating impedance at both terminals (the point B and the point C) of which an external load can be connected.

In FIG. 8, currents I1 and I2 become as follows.

$$I1=-(V1+V2)*gm \tag{5}$$

$$I2=-(V1+V2)*gm \tag{6}$$

An external load Z can be expressed in the following expression (7). As the external load Z, the one-terminal effector 30 of the present invention having the structure shown in FIG. 2 or FIG. 4 is connected.

$$Z=V2/I2=V2/\{(V1+V2)*gm\} \tag{7}$$

This expression (7) is expanded to obtain the following expression (8).

$$V2=V1*Z*gm/(1-Z*gm) \tag{8}$$

When the expressions (5) and (8) are substituted into Zin=V1/I1, the input impedance (Zin) at the point B is obtained as follows.

$$\begin{aligned} Zin &= V1/\{-(V1+V2)*gm\} \\ &= 1/\{-(1-Z*gm/(1-Z*gm))*gm \\ &= Z-(1/gm) \end{aligned} \tag{9}$$

When −(1/gm)=−R, the input impedance (Zin) at the point B becomes Zin=Z−R, and the external load Z is connected in series with the negative resistance −R.

Figure 9:
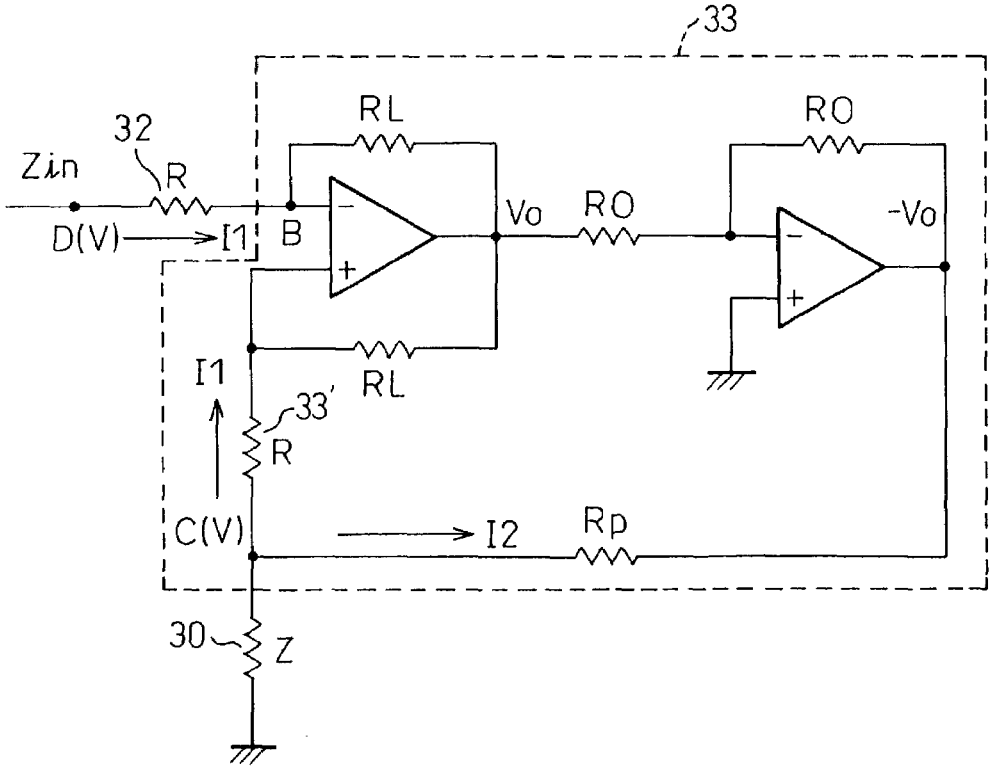
FIG. 9 is a diagram showing one embodiment of the floating negative impedance shown in FIG. 8.

FIG. 9 shows one embodiment of realizing the floating negative resistance 33 shown in FIG. 7A by using an OP amplifier.

In FIG. 9, realizing the floating negative resistance means setting the point D and the point C to the same potential D(V)=C(V). When this potential is V, the currents I1 and I2 and the external load Z satisfy the following relationship of the expressions (10), (11), and (12).

$$I1=(V-V0)/(R+RL) \tag{10}$$

$$I2=(V-(-V0))/Rp=(V+V0)/Rp \tag{11}$$

$$V=-Z*(I1+I2) \tag{12}$$

From the above expressions, the following expression (13) is obtained.

$$V/I1=Zin=((RL+R-Rp)*Z)/(2*Z+Rp) \tag{13}$$

When R<<RL and R<<Rp in the above expression (13), the following expression is obtained.

$$Zin\approx((RL-Rp)*Z)/(2*Z+Rp) \tag{14}$$

When RL=2Rp in the expression (14), the following expression is obtained.

$$Zin\approx(Rp*Z)/(2*Z+Rp) \tag{15}$$

Further, when Z<<Rp, the following expression is obtained.

$$Zin\approx Z \tag{16}$$

Therefore, it is possible to realize the floating negative resistance of the negative resistance −R that offsets the influence of R 32 between the point B and the point C.

Figure 10:
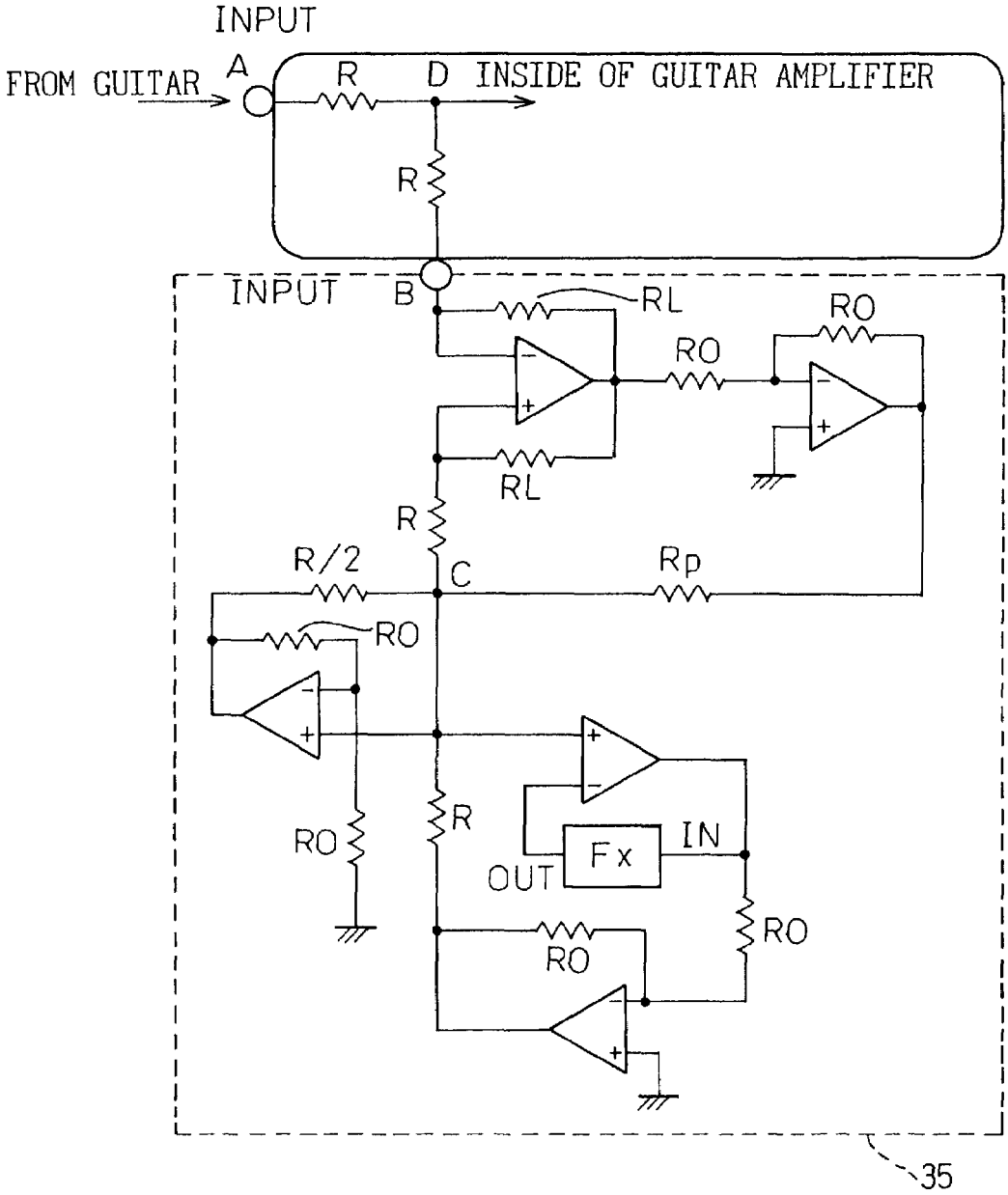
FIG. 10 is a diagram showing a detailed embodiment of a one-terminal effector according to the present invention.
Figure 14:
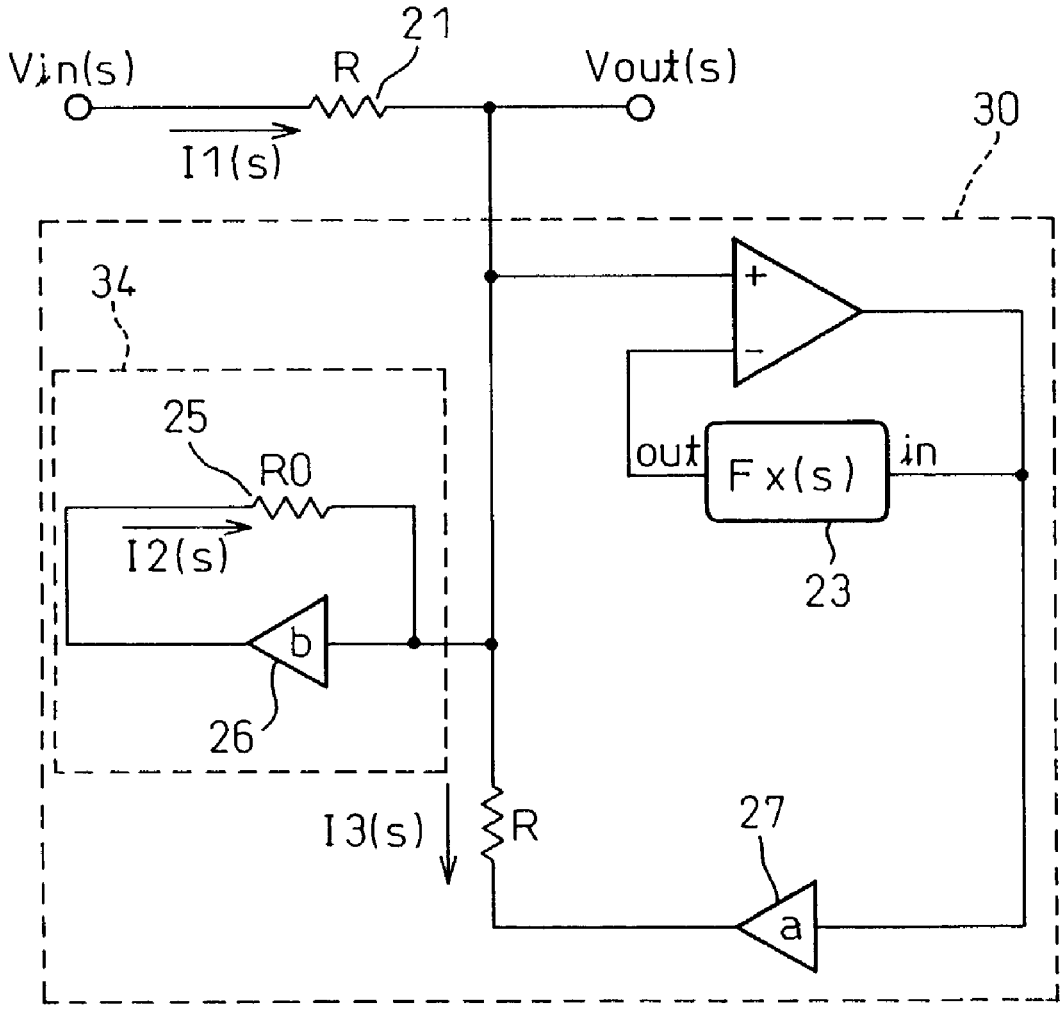
FIG. 14 is a diagram showing an embodiment of a one-terminal effector according to the present invention.

FIG. 10 shows a detailed embodiment of a one-terminal effector according to the present invention. FIG. 10 shows a detailed embodiment for realizing the one-terminal effector apparatus 35 using the second principle of the present invention shown in FIG. 4, by using an OP amplifier. This one-terminal effector apparatus 35 also includes the floating negative impedance circuit shown in FIG. 9. As the floating negative impedance circuit 33 has been explained with reference to FIG. 9, only the portion of the one-terminal effector 30 realized by using the OP amplifier circuit will be explained below with reference to FIG. 14.

When an input signal Vin(s) has been applied, currents I1(s), I2(s), and I3(s) that are generated within the circuit are in the relationship of I1(s)+I2(s)=I3(s). Therefore, the following expression (17) is established. In the expression (17), a represents a gain of an amplifier that has an input common with the input of Fx(s), and b represents a gain of an amplifier that is used to realize a negative resistance.

$$(Vin(s)-Vout(s))/R+Vout(s)*(b-1)/R0=Vout(s)*(1-a/Fx(s))/R \quad (17)$$

The expression (17) is rearranged as follows.

$$Vout(s)=(R0*Vin(s))/(R0-R*(b-1)+R0-R0*a/Fx(s)) \quad (18)$$

In the above expression, the portion of R0−R*(b−1)+R0 within the denominator is set to zero as follows.

$$R0=R*(b-1)/2 \quad (19)$$

Based on this, the expression (18) satisfies a relationship of Vout(s)=k*Fx(s)Vin(s) (where k is a constant). In FIG. 10, a=−1, and b=2 to set R0=R/2. It is also possible to prepare other constants that satisfies the expression (19) by setting B=3 and R0=R.

Next, one example of an extremely compact effector structure having a short cable length that is a one-terminal effector having the circuit structure shown in FIG. 10 will be explained. As explained above concerning the problems of the conventional technique, according to a conventional compact guitar effector, there has been a limit to the sizes of input and output jacks even when electronic parts are integrated. Consequently, there has been a limit to a reduction in the sizes of the guitar effector. On the other hand, according to the present invention, it is possible to make the input/output terminals common, and therefore, it is possible to realize a more compact apparatus.

Figure 11B:
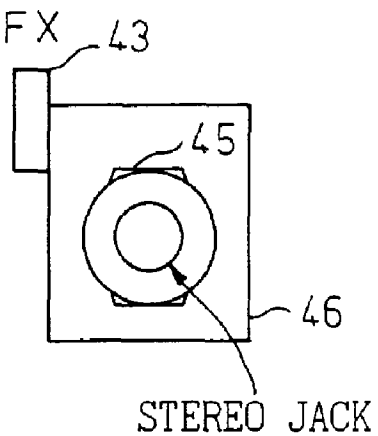
FIG. 11B is a rear view of an external structure of a one-terminal effector according to the present invention.
Figure 11A:
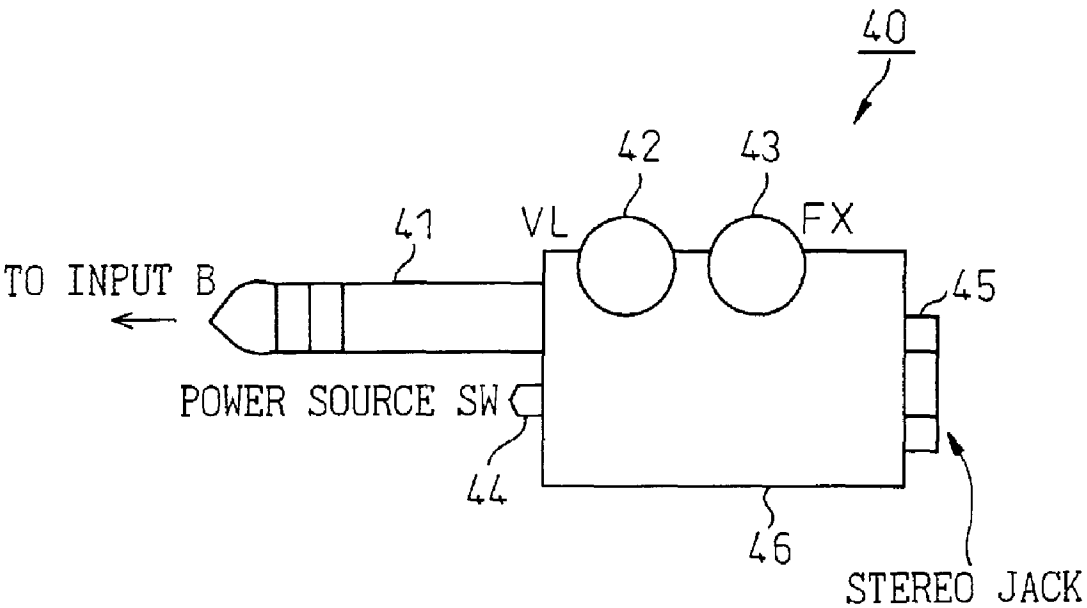
FIG. 11A is a side view of an external structure of a one-terminal effector according to the present invention.

FIGS. 11A and 11B show one example of an external structure of the one-terminal effector apparatus 40 according to the present invention. FIG. 11A is a side view and FIG. 11B is a rear view of this structure.

In FIGS. 11A and 11B, a reference number 41 denotes an input/output plug, 42 denotes a volume, 43 denotes a selection dial of a type of effector, 44 denotes a power source switch, and 45 denotes a stereo jack for connecting an external effector. A reference number 46 denotes an effector unit which includes all parts of a power source circuit and the effector circuit 30 shown in FIG. 10.

Figure 12:
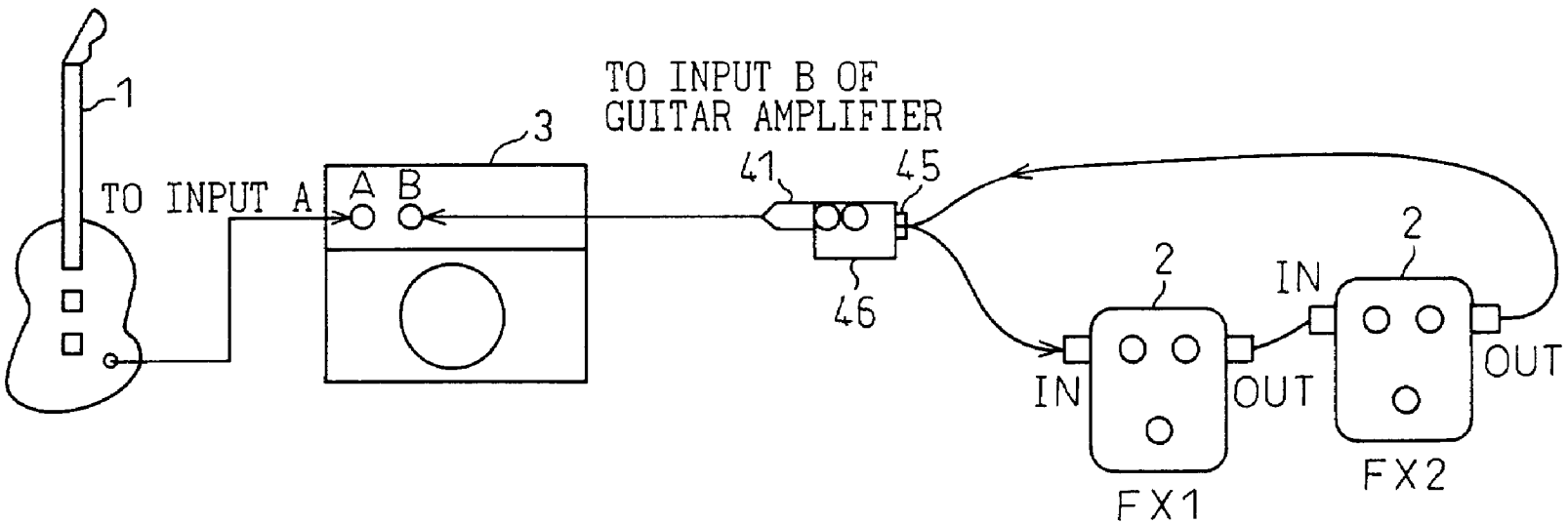
FIG. 12 is a diagram showing one example of a connection structure of a guitar using a one-terminal effector according to the present invention.

FIG. 12 shows one example of a connection structure of a guitar using a one-terminal effector 40 according to the present invention. This corresponds to a conventional connection structure shown in FIG. 1.

As shown in FIG. 12, a guitar 1 is directly connected to an input terminal A of a guitar amplifier 3 using a cable. The one-terminal effector 40 according to the present invention is directly connected to an input terminal B of the guitar amplifier 3. Therefore, when only one one-terminal effector 40 according to the present invention is used, a cable for connecting the effector is not necessary. As explained above, the one-terminal effector 40 according to the present invention has the stereo jack 45 for connecting an external effector. Therefore, it is possible to connect a plurality of conventional effectors in series to this stereo jack, if necessary.

Figure 13B:
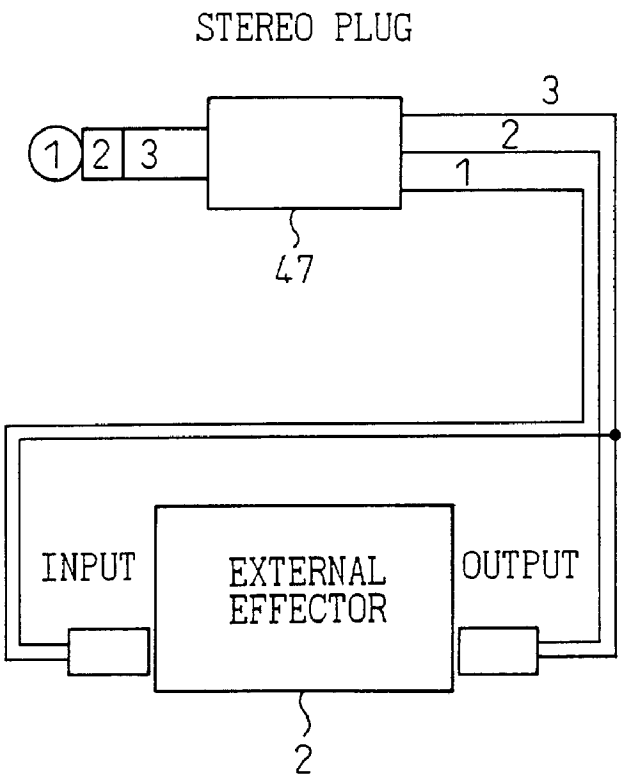
FIG. 13B is a diagram showing one example (2) of an internal structure of a one-terminal effector to which a conventional effector is externally connected.
Figure 13A:
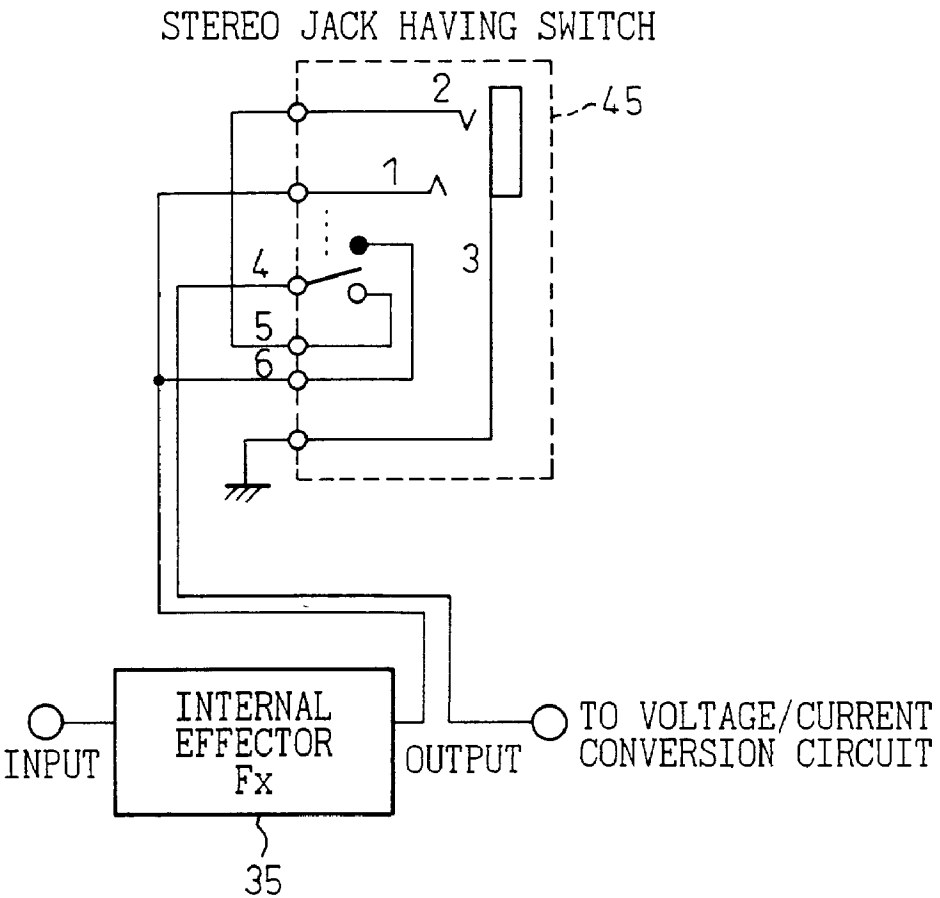
FIG. 13A is a diagram showing one example (1) of an internal structure of a one-terminal effector to which a conventional effector is externally connected.

FIGS. 13A and 13B show one example of an internal structure of the one-terminal effector 40 to which a conventional effector is externally connected.

FIG. 13A shows one example of a stereo jack having a switch as the stereo jack 45 to connect an external effector. FIG. 13B shows one example of a stereo plug 47 that connects a conventional effector 2. When this stereo plug 47 is inserted into the stereo jack 45 having a switch, the switch is changed over to connect an effector 35 incorporated in the one-terminal effector 40 and the external effector in series. In a status that the stereo plug 47 has not been inserted, only the incorporated effector 35 is connected.

As explained above, according to the effector of the present invention, only one input/output terminal is used. Therefore, it is possible to avoid complex wiring as experienced in the conventional effector. Further, it is possible to prevent an increase in noise or degradation of a high-frequency sound characteristics attributable to the cable wiring. At the same time, it is possible to satisfy the desire of guitarists to connect their guitars directly to a guitar amplifier using a cable without going through an effector.

Further, according to the present invention, it is possible to provide a compact effector apparatus by making the input/output terminals common. When only one effector is used, the wiring for this effector is not necessary. Further, it is also possible to use a conventional effector together with the effector of the present invention, by using minimum wiring. Furthermore, there is no limit to the external sizes of an apparatus like a mixer that requires many input/output terminals. As a result, it is possible to lower the manufacturing cost of the mixer.

What is claimed is:

1. A one-terminal effector directly connected to a second terminal of an audio amplifier that has a first terminal directly connected to an electrical instrument and the second terminal, the first and second terminals of which are connected to each other via inside resistors of the terminals, the one-terminal effector comprising:

an effector circuit that provides audio effect to a voltage signal input from the second terminal;

an input/output signal converter that converts the effected voltage signal output from the effector to a current signal provided to the second terminal; and a negative impedance circuit that cancels the inside resistor connected to the second terminal to each other.

2. The one-terminal effector according to claim 1, wherein the negative impedance circuit is structured as a floating impedance circuit that connects between the second terminal and the effector circuit.

3. The one-terminal effector according to claim 1, further comprising:

an external connection mechanism, wherein at least one external effector unit connected to the external connection mechanism is connected in series with the one-terminal effector.

4. A one-terminal effector directly connected to a second terminal of an audio amplifier that includes a differential amplifier having a first terminal directly connected to an electrical instrument and the second terminal, the one-terminal effector comprising:

an effector circuit that provides audio effect to a voltage signal input from the second terminal;

an input/output signal converter that converts the effected voltage signal output from the effector to a current signal provided to the second; and wherein the differential amplifier with a current feedback resistor connected between an output of the amplifier and the second terminal outputs the effected voltage signal by converting the current signal from the second terminal to a voltage signal through the current feedback resistor.

* * * * *